US006328220B1

(12) United States Patent
Taylor

(10) Patent No.: US 6,328,220 B1
(45) Date of Patent: Dec. 11, 2001

(54) HUMIDIFIER

(76) Inventor: Steve Taylor, 131 Pine Drive, Stoney Creek, Ontario (CA), L8G 3B8

( * ) Notice: Subject to any disclaimer, the term of this patent is extended or adjusted under 35 U.S.C. 154(b) by 0 days.

(21) Appl. No.: 09/548,436

(22) Filed: Apr. 12, 2000

Related U.S. Application Data

(60) Provisional application No. 60/129,381, filed on Apr. 15, 1999.

(51) Int. Cl.[7] ..... F24F 3/14
(52) U.S. Cl. ..... 237/78 R
(58) Field of Search ..... 237/78 R; 96/294; 239/17; 165/222

(56) References Cited

U.S. PATENT DOCUMENTS

| | | | | |
|---|---|---|---|---|
| D. 321,049 | | 10/1991 | Ghorayeb | D23/356 |
| 3,129,268 | * | 4/1964 | Evett | 237/78 R |
| 3,268,169 | * | 8/1966 | De Bree | 237/66 |
| 3,598,311 | | 8/1971 | Lauffenburger | 237/78 |
| 4,049,196 | | 9/1977 | Bergami et al. | 237/51 |
| 4,496,099 | * | 1/1985 | Bull | 237/7 |
| 5,067,473 | * | 11/1991 | Oh | 126/113 |
| 5,093,895 | | 3/1992 | Ghorayeb | 392/395 |
| 5,403,233 | * | 4/1995 | Daneshvar | 454/291 |
| 5,664,730 | | 9/1997 | Vallieres et al. | 237/78 |
| 5,955,006 | * | 9/1999 | Charnecky | 261/66 |

* cited by examiner

*Primary Examiner*—Harold Joyce
*Assistant Examiner*—Derek S. Boles

(57) ABSTRACT

A humidifier for installation in gas fired fireplaces of the type having an air intake opening and an air outlet opening and an airflow passage there between, in which air is warmed by a fireplace firebox, and exhausted into a room to be heated. The humidifier includes a water supply for supplying water to a water control valve. The water valve communicates with a humidifier pan for filling said pan with water and selectively controlling the water depth in said pan. The pan stores water and is mounted in close proximately to said warmed air such that water in said pan evaporates thereby humidifying the warmed air being exhausted.

13 Claims, 9 Drawing Sheets

12
52
10

14
62
60
20

56
6

7
22
7
60
56
56
18
57
6
54

16
14
62
52
12

90

58
54
14

56
14
12

16
14
54
58
12
28
30
32
42
50

HUMIDIFIER

This application claims benefit of Provisional application Ser. No. 60/129,381 filed Apr. 15, 1999.

FIELD OF THE INVENTION

This invention relates to a humidifier and more particularly to a humidifier for installation in gas fired fireplaces.

BACKGROUND OF THE INVENTION

The maintenance of the proper amount of humidity in the air is important for the well being of humans. It is recommended that the humidity level in normal living environments be maintained at approximately 40 to 50% at normal room temperature of 20° centigrade (or approximately 72° F.). The total humidity which the air contains is related to the temperature of the air at any given point in time. In the summer time for example, humidity levels often exceed 50%, however, in the winter time the air tends to be dryer since the air exchange in the home is between the exterior air which is at a much colder temperature as compared to the interior air of the home. Therefore, in the winter time, it is normally necessary to add humidity to the air in order to achieve the 40 to 50% humidity levels which are recommended for normal home living conditions.

With the increasing cost of fuel for heating homes, much effort has been devoted to employing gas fireplaces in a manner which would allow them to become more efficient in heating an entire room or an entire home. Although auxiliary gas fireplaces have become more efficient and popular in numbers, these units have suffered from various deficiencies, including for the most part the inability to provide humidification to the room which is being heated.

Various apparatus has been developed and patented over the years to provide auxiliary humidification into residential homes and buildings. For example, U.S. Pat. No. 5,093,895 invented by Joseph Ghorayeb entitled Humidifier Attachable to Baseboard Radiator and issued on Mar. 3, 1992 as well as U.S. Pat. No. 4,049,196 invented by Samuel S. Bergami et al entitled Fireplace Heater, Circulator, and Humidifier System issued Sep. 20, 1977 as well as U.S. Pat. No. 5,664,730 invented by Jean-P. Vallieres entitled Humidifier Device and issued Sep. 9, 1997. The draw back with the existing prior art devices is that they are not suitable for use with gas fired fireplaces nor are they of suitable dimension and/or design to be retrofitted with existing gas fired fireplaces, nor do they allow for the fine control of humidification to a desired level. There is a need therefore, for a humidification device which can be used and installed with an existing gas fired fireplace and/or with a new installation for gas fired fireplaces which allows a user to selectively adjust the humidification that is provided in a environment around the gas fired fireplace.

SUMMARY OF THE INVENTION

The present invention is a humidifier for installation in gas fired fireplaces of the type having an air intake opening and an air outlet opening and an airflow passage there between, in which air is warmed by a fireplace firebox, and exhausted into a room to be heated, the humidifier comprising:

(a) a container means for storing water and mounted in close proximately to said warmed air;

(b) a water control communicating with said container means for filing said container means with water and selectively controlling the water depth in said container means;

(c) a water supply for supplying water to said water control means.

Preferably said container means comprises:

(a) a reservoir for housing said water control means and storing water;

(b) an evaporation means, fluidly connected and receiving water from said reservoir said evaporation means for exposing water to said warmed air for facilitating evaporation of water thereby humidifying said warmed air.

Preferably the water depth of the evaporation means is less than the water depth in said reservoir such that said reservoir fills before said evaporation means fills.

Preferably said evaporation means comprises an evaporation pan mounted in close proximity to said firebox and said warmed air such that water in the evaporation pan, is heated by heat emanating from the firebox and also by warmed air passing over the water in the pan.

Preferably said evaporation pan further comprises wicking means for accelerating and enhancing the rate of evaporation of water in the pan.

Preferably said wicking means comprises upstanding wicks partially submerged in the water in the pan and partially exposed to the warmed air thereby increasing the evaporation rate of water in the pan.

Preferably said evaporation pan comprises a sloped bottom wall such that the greater the water depth in the evaporation pan the greater the surface area of the water in the pan thereby the humidification rate can be adjusted by controlling the depth of water in the evaporation pan.

Preferably said humidifier includes shims placed under the evaporation pan, the shims placed in such a manner to provide a sloped bottom wall such that the greater the water depth in the evaporation pan the greater the surface area of the water in the pan thereby the humidification rate can be adjusted by controlling the depth of water in the evaporation pan.

Preferably the water control means comprises:

(a) a float communicating with the water level in the container means;

(b) a water valve communicating with said float for adding water to said container and thereby maintaining the water depth in said container means at a preselected level.

Preferably said wicking means includes water adsorptive materials useful for wicking water which can accelerate and enhance the rate of evaporation of water in the pan.

Preferably said wicking means includes a plurality of wick holders for receiving said wicks such that wicks can be selectively placed in wick holders such that the humidification rate can be selected by increasing or decreasing the number of wicks.

BRIEF DESCRIPTION OF THE DRAWINGS

The invention will now be described by way of example only, with references to the following drawings in which.

DETAILED DESCRIPTION OF THE PREFERRED EMBODIMENT

Figure 8:
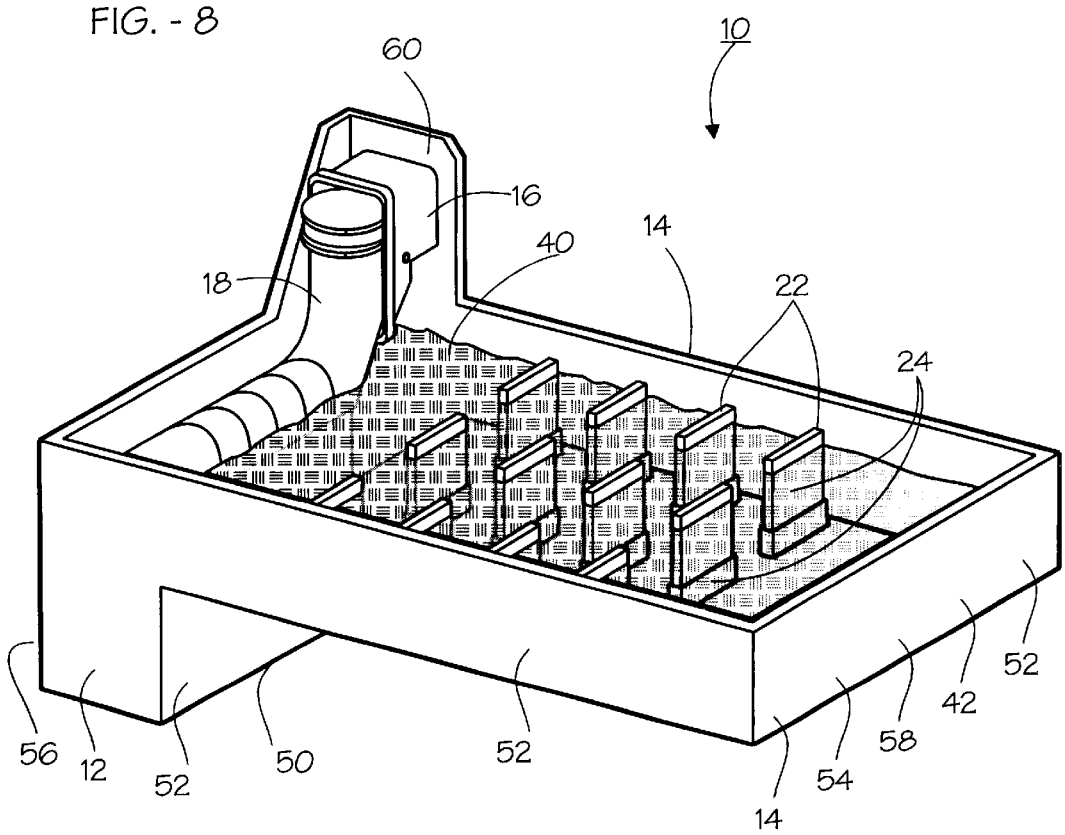
FIG. 8 is a perspective view of the preferred embodiment of the humidifier shown in FIGS. 1 through 7.

Referring first of all to FIG. 8 which shows in perspective view the present invention a Humidifier shown generally as 10 comprising a reservoir 12, evaporation pan 14, a water valve 16, a float 18, a number of wicks 22, wick holders 24, water 40 having a water depth 42.

Reservoir 12 has a reservoir end wall 56, a reservoir bottom wall 50, reservoir inner wall 57 as well as side walls 52 which are shared with evaporation pan 14. Evaporation pan 14 as well has a pan bottom wall 58 which is vertically higher than reservoir bottom wall 50. One of the side walls 52 has a flange 60 for mounting water valve 16 thereon.

As shown in FIG. 8, reservoir 12 is fluidly connected to evaporation pan 14 and the two together form a container for holding water 40 which for example can be filled to a water depth of 42.

Figure 7:
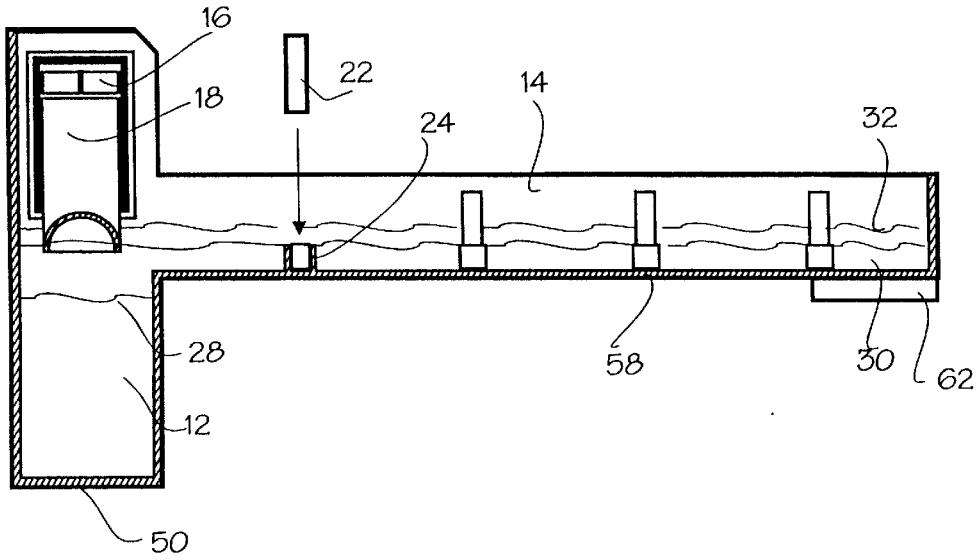
FIG. 7 is a side cross-sectional view taken along lines 7–7 shown in FIG. 3 of the humidifier.

Referring now specifically to FIG. 7, wick holders 24 are attached to pan bottom wall 58 and are dimensioned to receive wicks 22. Wicks 22 can be made from any material known in the art for wicking water into the wicking material and thereby exposing a greater amount of water to the flow of air over humidifier 10. FIG. 7 also shows three particular water depths, the first being low water depth 28 in which the water is only contained in reservoir 12 and there is no water in evaporation pan 14. Secondly medium water depth 30 which shows water completely filling reservoir 12 and as well a small amount of water residing in the bottom of evaporation pan 14. At this particular water level, water does not reach wicks 22 because of the shielding action of wick holders 24 which prevent the water from reaching wicks 22 until water depth 42 has at least reached a level to cover the vertical projection of wick holders 24 on pan bottom wall 58. In the third water depth shown in FIG. 7, namely high water depth 32, reservoir 12 is completely filled, as well evaporation pan 14 is substantially filled and water has risen above the vertical projection of wick holders 24 and therefore wicks 22 are exposed to water within evaporation pan 14 and the wicks become effective and begin wicking water away and out of evaporation pan 14.

Figure 6:
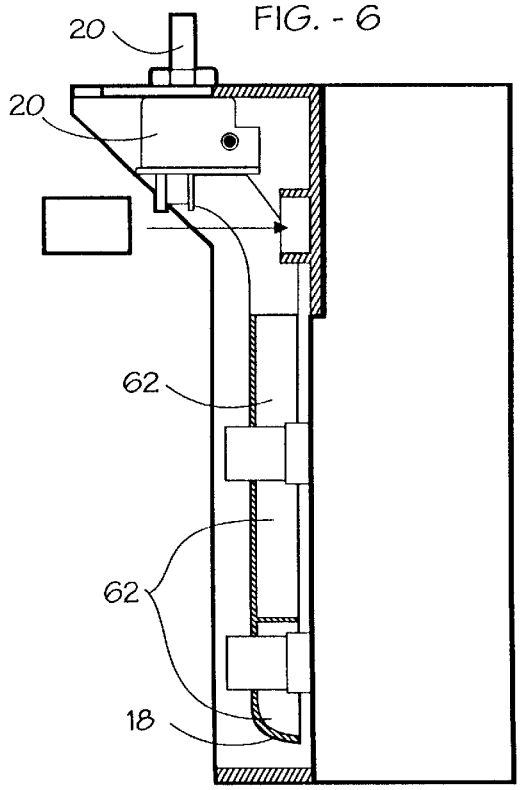
FIG. 6 is a side cross-sectional view taken along lines 66 shown in FIG. 3;.

Referring now to FIG. 6 which shows some of the details of float 18, water valve 16 and water supply line 20, float 18 is of any type that is commercially available and the type shown is essentially an open air compartment type float. As water depth 42 reaches float 18, air compartment 62 becomes entrapped with air therefore, forcing float 18 upwards against an actuator in water valve 16. Water valve 16 may be any commercially available water valve which will act in conjunction with a float to turn water on and off at a predetermined and preselected float level. Water supply to reservoir 12 and evaporation pan 14 comes from water supply line 20 which normally speaking is normal household city and/or drinking water which is fed through water valve 16 into reservoir 12 and eventually into evaporation pan 14.

Figure 9:
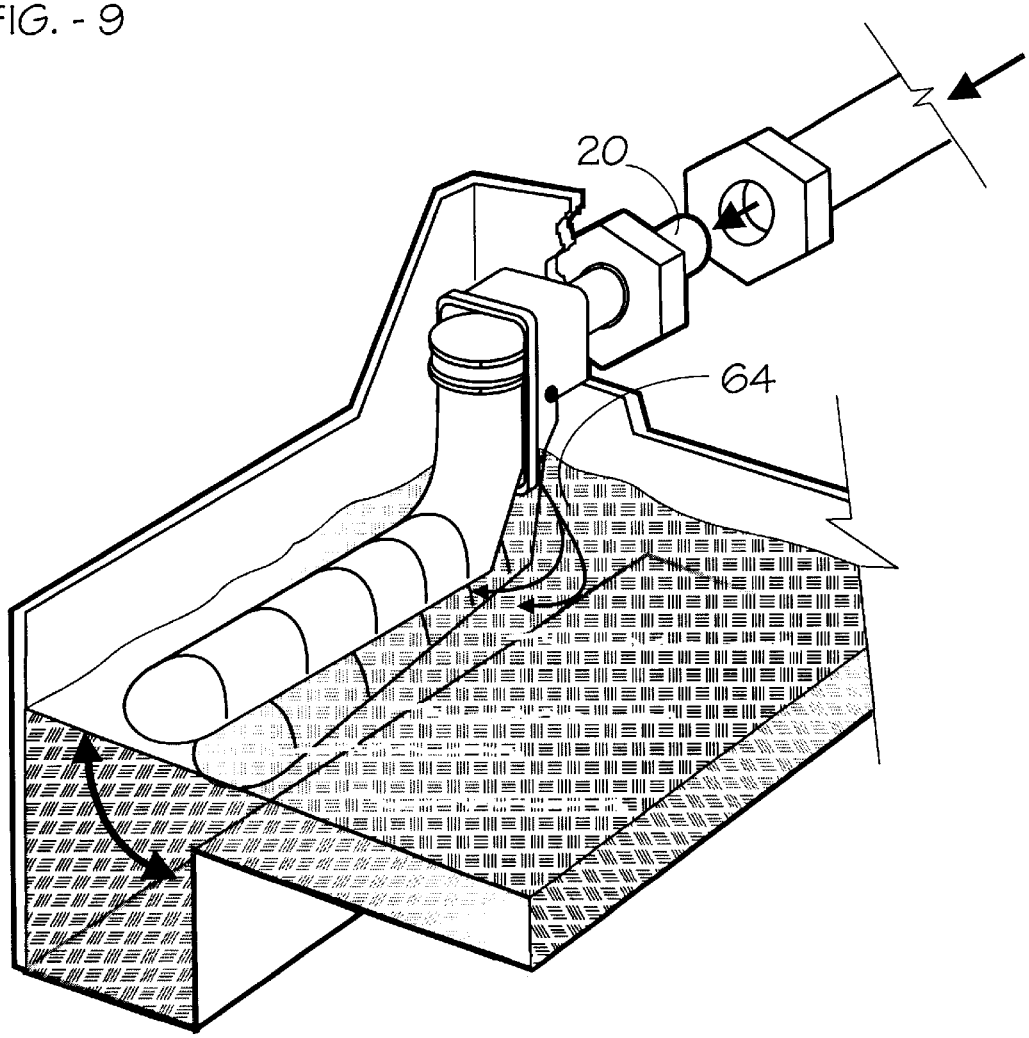
FIG. 9 is a partial cut away perspective view showing the water supply line to the humidifier.

FIG. 9, in particular, shows the action and the tilting action of float 18 and how water is discharged from the bottom of water valve 16 as float 18 sinks below a certain predetermined level and water discharge 64 is terminated when float level 18 has reached a preselected level thereby providing a preselected water depth 42 inside of reservoir 12 and evaporation pan 14. The combination water valve 16, float 18 and water supply line 20 enables the user to pre-selectively control any water depth 42 within reservoir 12 and evaporation pan 14.

Figures 1, 2, 3, 4, 5:
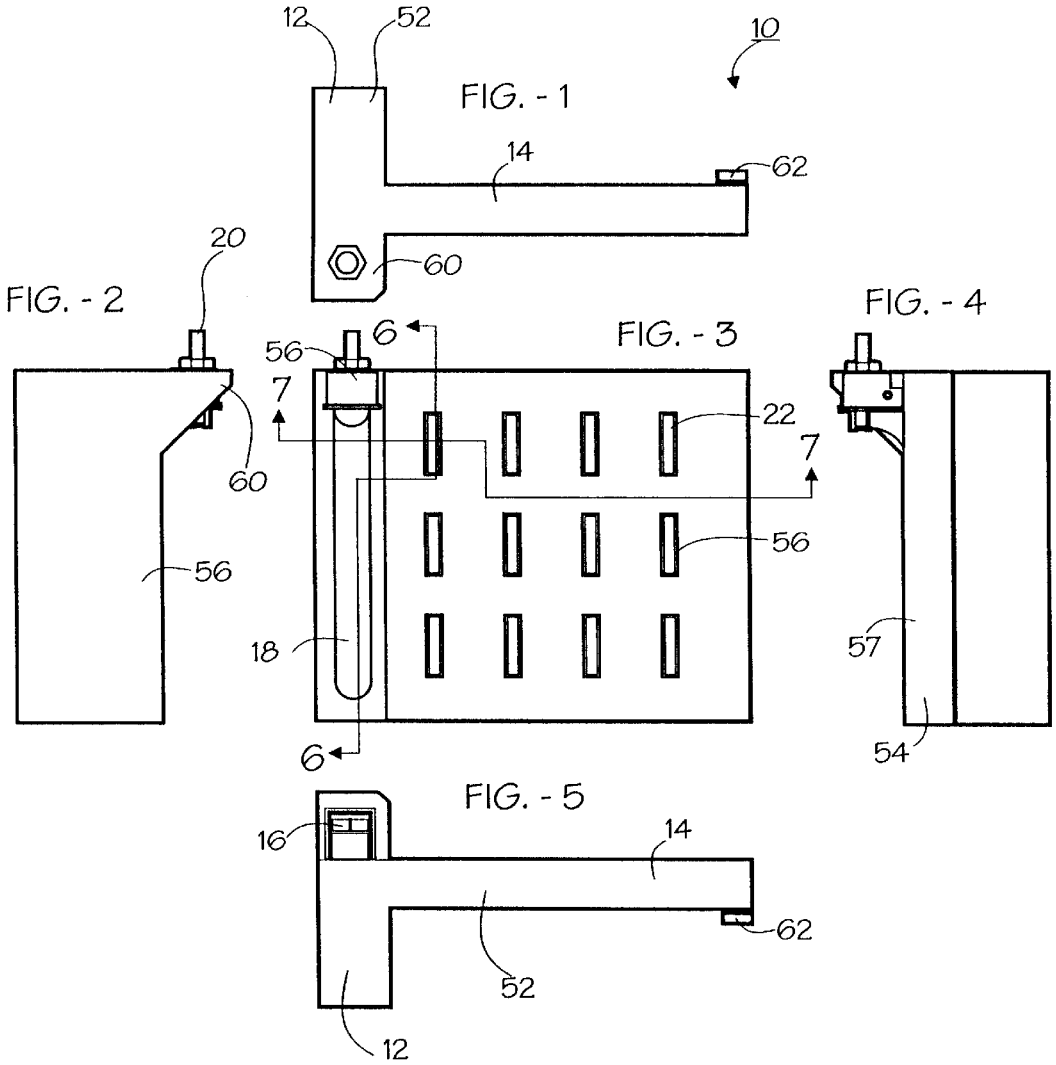
FIG. 1 is a side elevational view of a preferred embodiment of a humidifier shown in FIG. 3.
FIG. 2 is a side elevational view of preferred embodiment of a humidifier shown in FIG. 3.
FIG. 3 is a top plan view of a preferred embodiment of a humidifier.
FIG. 4 is a side elevational view of a preferred embodiment of a humidifier shown in FIG. 3.
FIG. 5 is a side elevational view of a preferred embodiment of a humidifier shown in FIG. 3.

Referring now specifically to FIGS. 1 and 5, optionally shims 62 can be used to raise a pan bottom wall 58 from making contact with fire box 70, and/or depending on how the shims are mounted allow the user to select whether or not pan bottom wall 58 is mounted perfectly horizontally and/or is slightly tilted so that when reservoir 12 and evaporation pan 14 are filled, the pan bottom wall 58 is not simultaneously covered by the rising water depth 42, but rather is gradually covered over with water as the water rises from the reservoir side of pan bottom wall 58 to the pan and wall side 54. This is better shown and explained in FIGS. 11 through 15 as described as follows.

Figures 11, 12, 13, 14, 15:
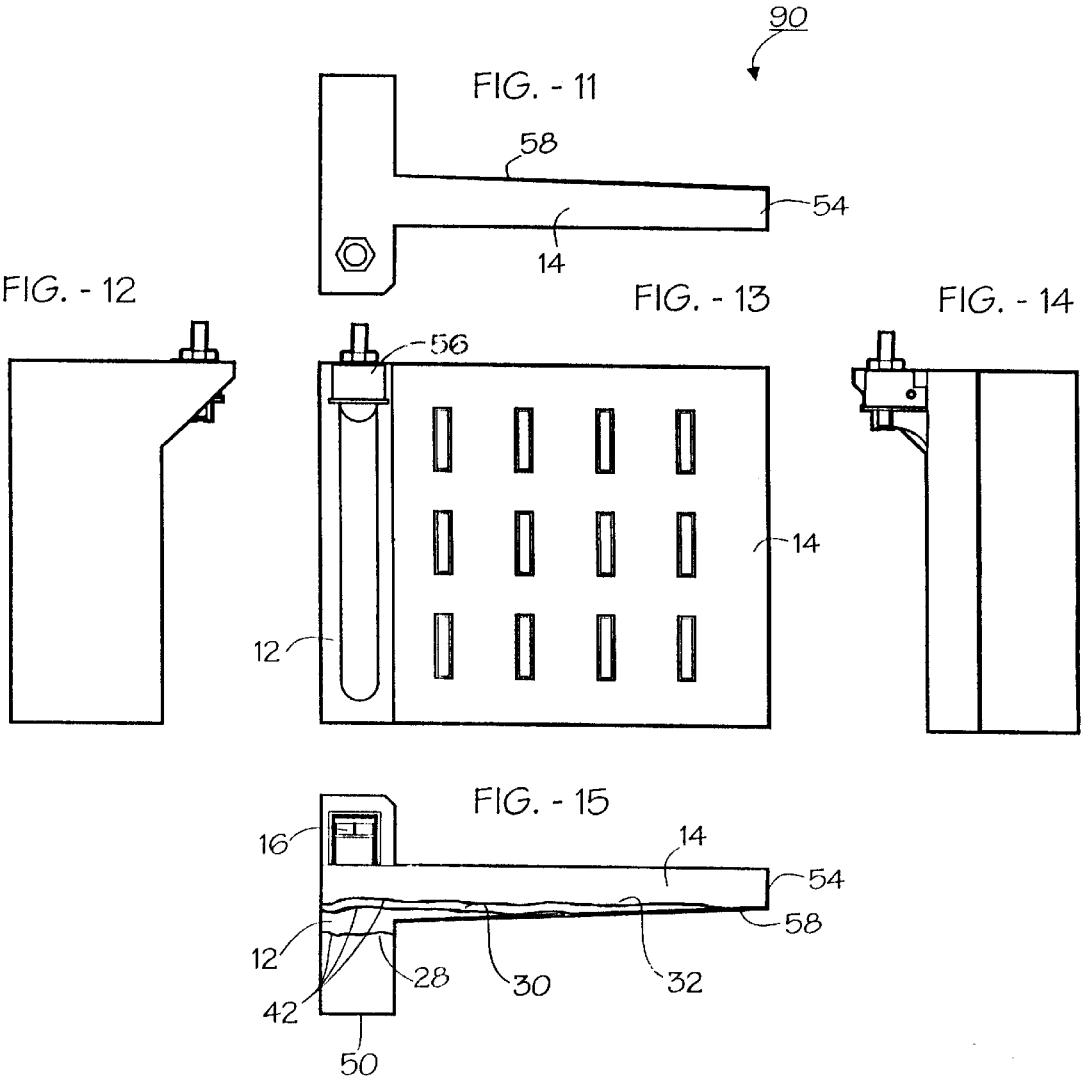
FIG. 11 is a side elevational view of an alternate preferred embodiment of the present invention, a Humidifier shown in FIG. 13.
FIG. 12 is a side elevational view of an alternate preferred embodiment of the present invention, a Humidifier shown in FIG. 13.
FIG. 13 is a top plan view of an alternative preferred embodiment of the present invention, a humidifier.
FIG. 14 is a side elevational view of an alternate preferred embodiment of the present invention, a humidifier shown in FIG. 13.
FIG. 15 is a side elevational view of an alternate preferred embodiment of the present invention, a humidifier shown in FIG. 13.

Referring now to FIGS. 11 through 15 an alternate embodiment of the humidifier shown generally as 90, rather than using shims 62 as shown in FIGS. 1 and 5, the pan bottom wall 58 optionally can be designed not to lie horizontal in relation to the reservoir bottom wall 50. By slightly sloping the pan bottom wall 58 upwardly from the reservoir 12 towards the pan and wall 54 as shown in FIGS. 11 and 15 as the water depth 42 rises, the pan bottom wall 58 is gradually covered over rather than simultaneously covering over the entire pan bottom wall 58.

Particularly shown in 15 are three pertinent water levels namely, low water depth 28 in which water is only contained within reservoir 12. Medium water depth 30 in which the entire reservoir 12 is filled as well as evaporation pan 14 is partially filled and only part of pan bottom wall 58 is covered and for example a high water depth 32 in which most of pan bottom wall 58 is covered over and as well reservoir 12 is completely fall. In this manner by selecting the water depth 42, one can vary the surface area of the water that is exposed to air. At low water depth 28, the surface area of water exposed to air is at a minium, where as at medium water depth 30, the surface area of water exposed to the air is much greater and at high water depth 32 the surface area of water exposed to air is again increased versus medium water depth 30 and low water depths 28. In this manner, one can see that by raising the water levels, the amount of water surface area exposed to the air is increased until the water depth completely covers the pan bottom wall 58 at which time the water level would than just rise vertically and no further changes in the surface area of water exposed would take place.

Figure 16:
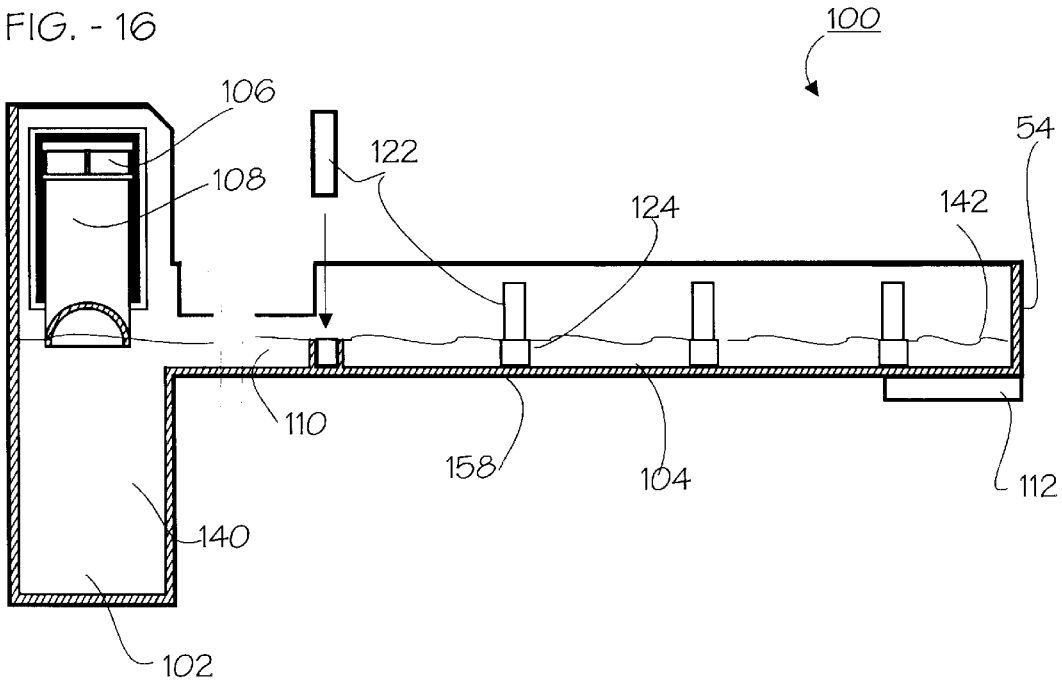
FIG. 16 is a side elevational view of a presently preferred embodiment of the present invention, a humidifier.

Referring now to FIG. 16 which show a presently preferred embodiment of the humidifier shown generally as 100, comprising a reservoir 102, evaporation pan 104, containing water therein 140, having a connecting tube 110 which joins reservoir 102 with evaporation pan 104 and communicates water between reservoir 102 and evaporation pan 104 and similar to the previous embodiments having a float 108, water valve 106, wick supports 124, wicks 122 and optionally shims 112.

Figure 17:
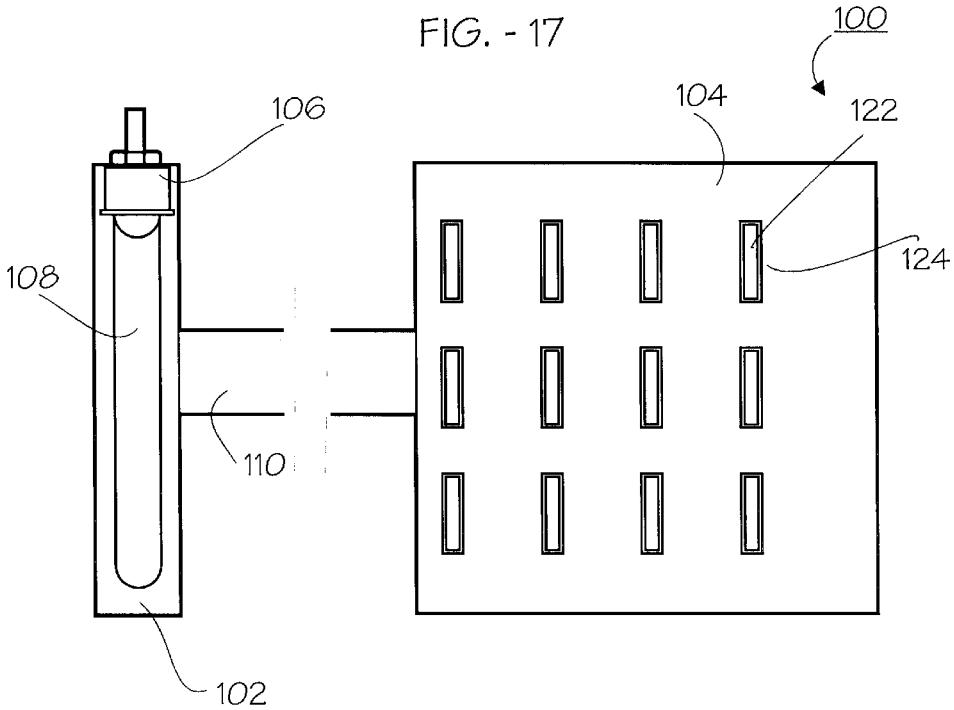
FIG. 17 is a top plan view of the presently preferred embodiment of the present invention, a humidifier shown in FIG. 16.
Figure 18:
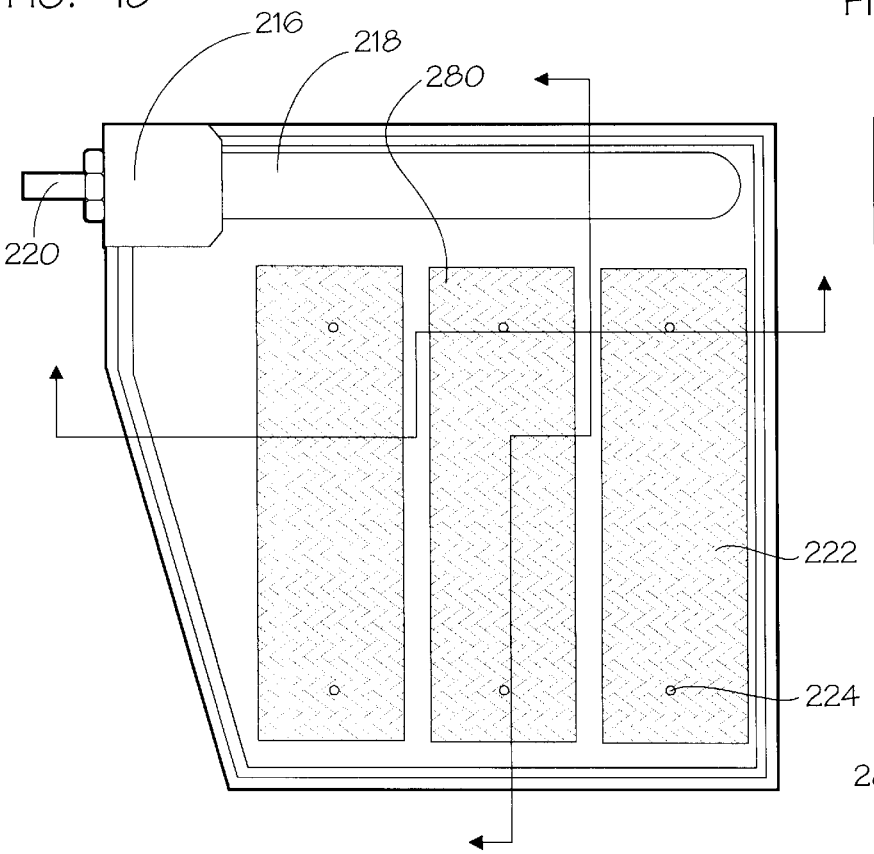
FIG. 18 is a top plan view of an alternate preferred embodiment of a flat humidifier.
Figure 19:
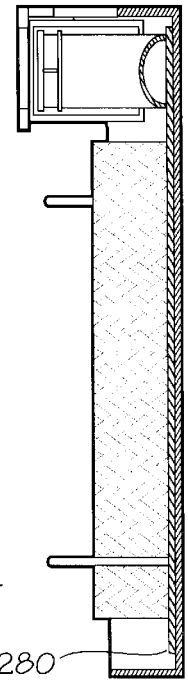
FIG. 19 is a side elevational view of an alternate preferred embodiment of a flat humidifier shown in FIG. 21.
Figure 20:
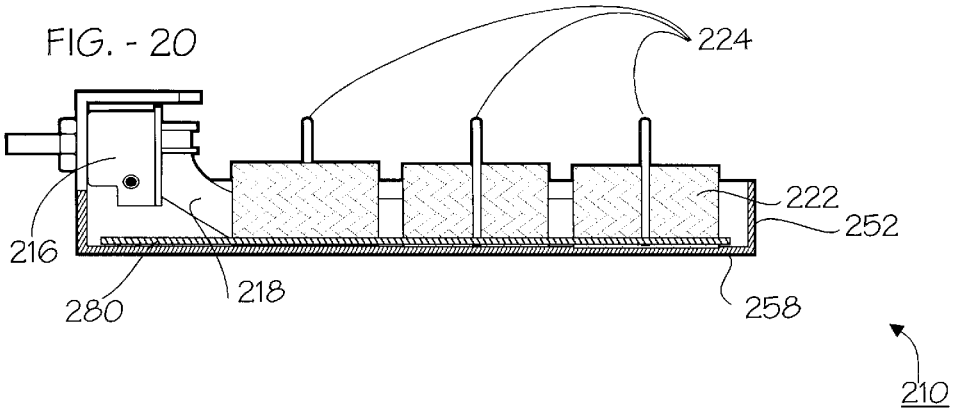
FIG. 20 is a side elevational view of an alternate preferred embodiment of a flat humidifier shown in FIG. 21.
Figure 21:
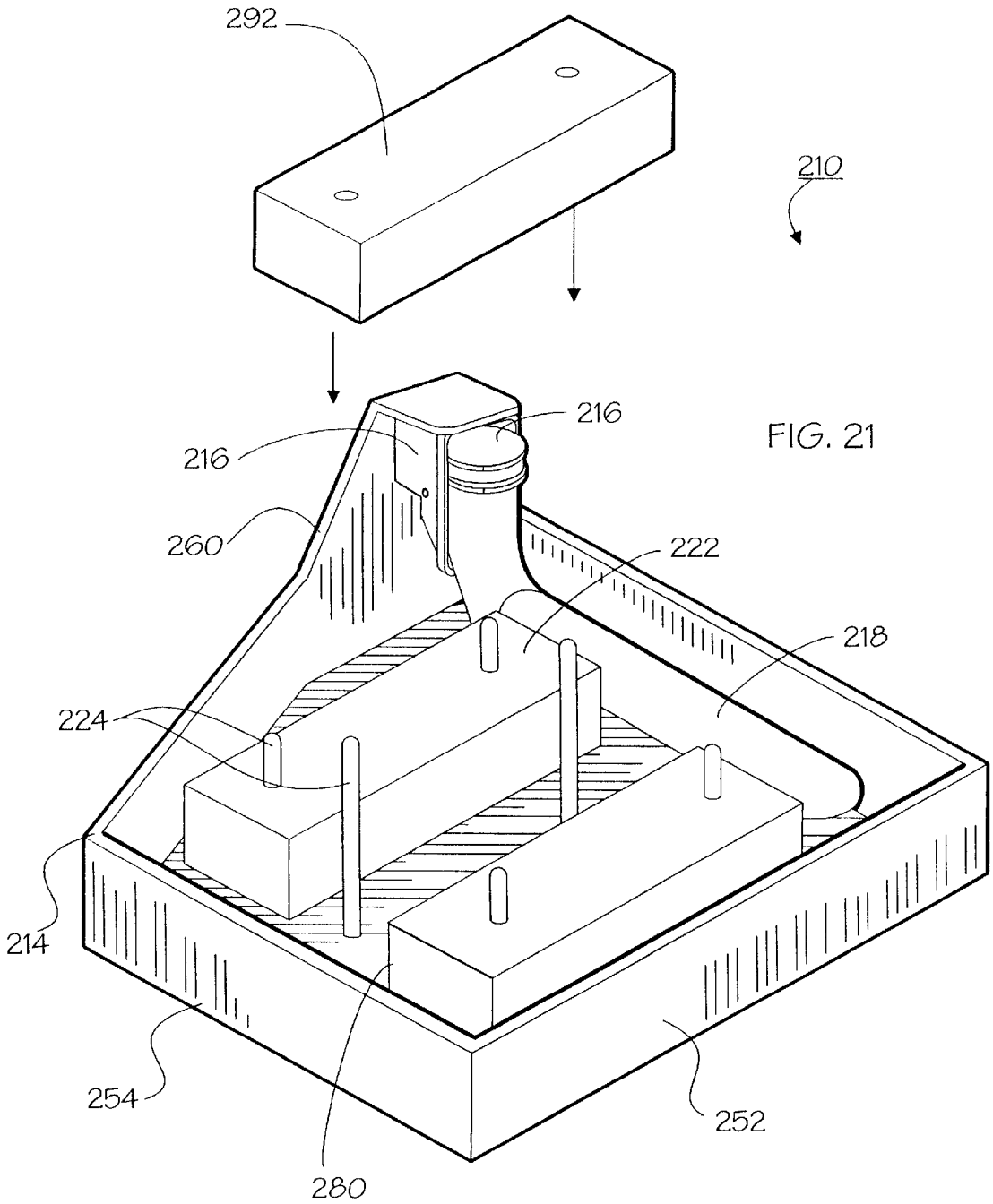
FIG. 21 is a perspective view of the alternate preferred embodiment of the Flat Humidifier shown in FIGS. 18 through 20.

In this presently preferred embodiment shown generally as 100 the major difference is that reservoir 102 can be located in a location remote from evaporation 104. Tube 110 may in fact be a flexible plastic tube and/or made from any other material which will provide for the communication of water 140 from reservoir 102 to evaporation pan 104. Water 140 will find its level in the same manner as the previous embodiments, therefore a person skilled in the art will realize that reservoir 102 will need to be located at such a level in order to ensure that the water level within evaporation pan 104 is suitably controllable. In every other way humidifier shown generally as 100 operates in the same manner as described before in the previous embodiments including the optional use of shims 112 in order to raise evaporation pan slightly away from the fire box and/or to design the evaporation pan 104 such that the one end of pan bottom wall 158 is somewhat higher than the other end of pan bottom wall 148 in a similar fashion as shown in FIGS. 11 and 15 where the pan bottom wall does not lie on a horizontal plane. A person skilled in the art will realize that the presently preferred embodiment of humidifier 100 allows for a remote location of the reservoir relative to evaporation pan 104. This may in fact be necessary depending on the space of availability around firebox 70 of gas fireplace 74. In addition, by separating reservoir 102 from evaporation pan 104 and connecting them fluidically by utilization of tube 110, allows some manufacturing efficiencies by enabling a standard reservoir size 102 to be built as well as standard evaporation pan sizes 104 to be built independently of each other. In addition, tube 110 need not be horizontal as shown in FIG. 16 and 17, but may in fact be bowed upward or downward and/or contain either radiuses and bends to circumvent any obstacles which may be around firebox 70 in order to supply water 10 from reservoir 102 to evaporation pan 104.

Figure 10:
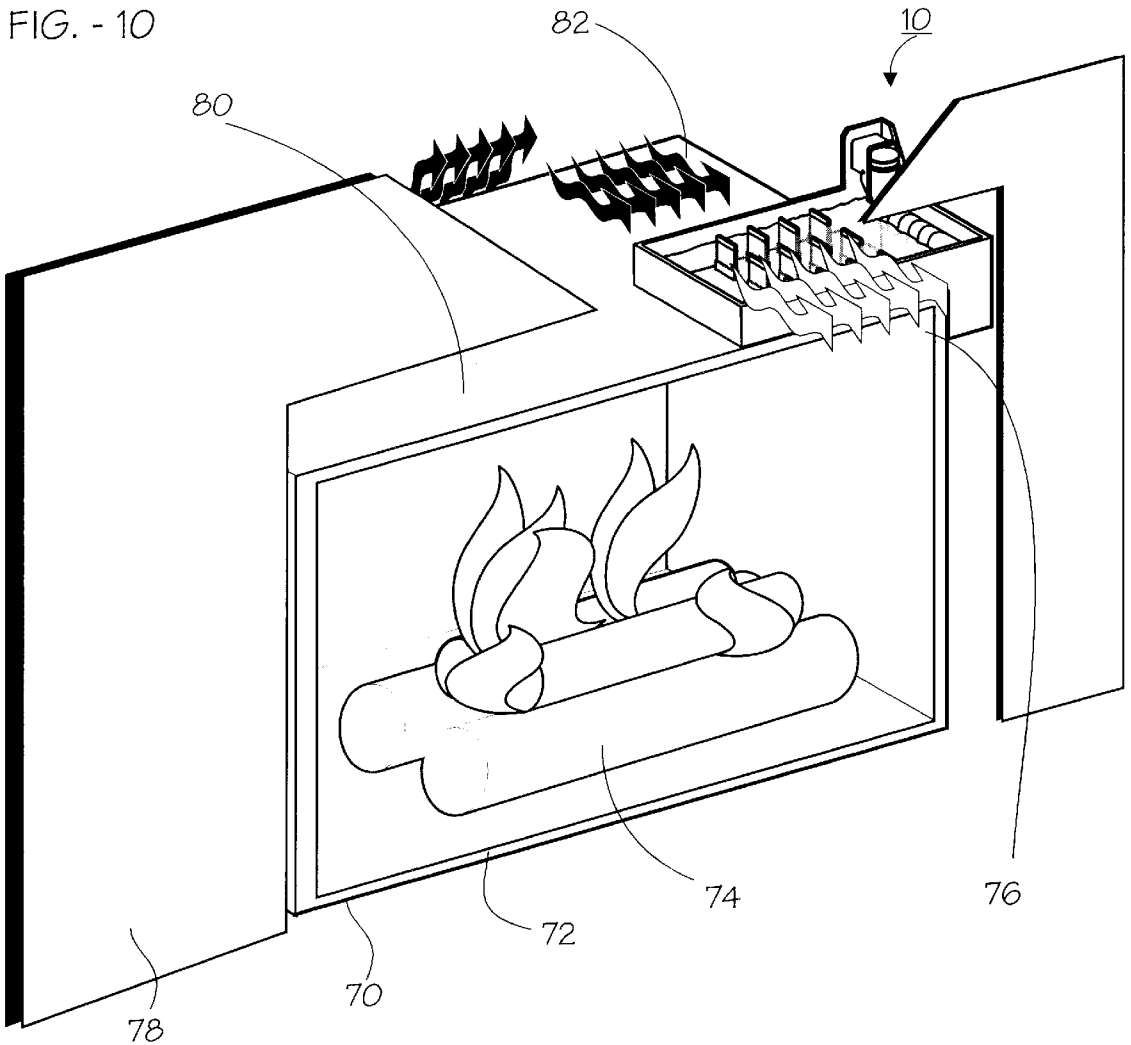
FIG. 10 is a perspective view of a preferred embodiment of the humidifier made in accordance with the subject invention mounted in a schematic representation of a portion of a gas fired fireplace showing the fire place mantel, the fire box, the air intake opening and outlet opening and the humidifier mounted on top of the fire box.

In use, humidifier 10 is shown in particular in FIG. 10 mounted in a gas fire place 74 which has a fire box 70, a mantel 78, an air intake opening 72 on the bottom and an air outlet opening 80. Warm air which flows in from air intake opening 72, around the bottom, back, and top of fire box 70 is warmed as it travels around the fire box such that warmed air 82 flows over the top of fire box 70, and subsequently over the top of humidifier 10 which releases moisture into warm air 82 therefore exhausting humidified air 76 through outlet opening 80 and into the surrounding room where the gas fire place 74 is housed.

One skilled in the art of humidification will know that the greater the surface area of water exposed to the warm air 82, the greater the humidification that will take place. Therefore, by controlling the amount of surface area of water being exposed to warm air 82, one can control the amount of humidification exhausted into the room.

The first preferred embodiment described in FIGS. 1 through 9 essentially have a horizontal pan bottom wall 58. This allows for three variations in humidification control. In FIGS. 7 when the water is controlled to the low water depths 28 by water valve 16 and float 18, a small amount of water, surface area is exposed to the warmed air 82 flowing over humidifier 10. If however, the water level is allowed to rise to medium water depth 30, essentially the entire pan bottom wall 58 is covered over with water and the amount of water surface area exposed to warmed air 82 is greatly increased. However, at medium water depth 30, the wicks 22 are inactive and do not aid in humidification. By further raising the water level depth to high water depth 32, the entire reservoir and pan bottom wall 58 are covered over, as well wicks 22 are immersed and exposed to water and therefore become active and begin wicking water up thereby further increasing the humidification that occurs with humidifier 10. Therefore, one skilled in the art will realize that there are three discreet levels of humidification controls that are available to the user with just a horizontal pan bottom wall 58 and the configuration as shown.

Further by using shims 62, pan bottom wall 58 can be raised off of fire box 70 in order to lower the rate of evaporation by decreasing the amount of heat transferred to water 40 within humidifier 10. Alternately sim 62 can be used to slightly tilt pan bottom wall 58 so that it is slightly sloped upwardly away from reservoir 12 and/or the same effect can be obtained by using the second preferred embodiment shown in FIGS. 11 through 15 in which pan bottom wall 58 is designed from the beginning with a slope upwardly in relation to reservoir 12 such that as the water level rises up out of reservoir 12 the water level will determine the amount of surface area of water is exposed to warm air 82. Referring particularly to FIG. 15 and as already described at low water depth, very little water surface area is exposed to the warmed air were as in at medium water depth 30, a greater amount of water surface is exposed to warm air 82 and finally at high water depth 32 the greatest amount of surface are is exposed to warmed air 82.

In this manner, the amount of water surface area can be discretely and continuously controlled from very little to the maximum amount by controlling the water depth 42 of humidifier 10. As well in order to obtain maximum humidification, the water depth is controlled to the maximum level so that wicks 22 are exposed and touching water 40 and therefore become active and aid in the humidification process.

Referring now to FIGS. 18 through 21, an alternate preferred embodiment is shown generally as flat humidifier 210. Flat humidifier 210 operates in an analogous fashion as humidifier 10 shown in FIGS. 1 through 15. The notably differences between flat humidifier 210 and humidifier 10 are the lack of reservoir 12 which in flat humidifier 210 is intrically part of evaporation pan 214. In addition, flat humidifier 210 has a removable bottom 280 not shown in FIGS. 1 through 15 of humidifier 10. Removable bottom 280 is fitted with wick holders 224 for supporting and holding wick material 222 as depicted in FIGS. 18 through 21. Wicking material 222 can be of any type known in the art, and particularly, faded or separated paper type wicking material work suitably with the kind of an arrangement. Additionally, safety cover 292 is fitted onto flange 260, evaporation pan 214 for protecting water valve 216.

The major components of the alternate presently preferred embodiment, namely: flat humidifier 210, evaporation pan 214, water valve 216, float 218, water supply line 220, wicking material 222, wick holders 224, side wall 252, end wall 254, bottom wall 258, flange 260, removable bottom 280 and safety cover 292.

In all other aspects other than as explained above, flat humidifier 210 operates in an analogous fashion to humidifier 10.

The notable differences are the lack of reservoir 12 which is intrically part of evaporation 214 and the addition of removable bottom 280 which is not found in humidifier 10.

Removable bottom 280 can easily be removed from evaporation pan 214 by titling the portion of removable bottom 280 closest to end wall 254 which is opposite to float 218, and thereby, tilting removable bottom 280 up and out from under float 218. In removing removable bottom 280 facilitates cleaning of bottom of flat humidifier 210 as well as removal and replacement of wicking material 222 simply by sliding wicking material 222 on and off wick holders 224. Although not shown in FIGS. 18 through 21, removable bottom 280 may not be present directly below float 218 in order to provide for additional floating space and water below float 218.

As in the previous embodiments a number of wick holders 224 provided for placing wicking material 222 thereon. One can selectively choose the amount of wicking material 222 placed onto wick holders 224, thereby, controlling the amount of evaporation one desires. The present embodiment flat humidifier 210 is a more easily manufactured design than previous embodiment humidifier 10 as well the addition of removal bottom 280 allows for easier cleaning maintenance and replacement of wicks of flat humidifier 210.

It should be apparent to persons skilled in the arts that various modifications and adaptation of this structure described above are possible without departure from the spirit of the invention the scope of which defined in the appended claim.

I claim:

1. A humidifier for installation in gas fired fireplaces of the type having an air intake opening and an air outlet opening and an airflow passage there between, in which air is warmed by a fireplace firebox, and exhausted into a room to be heated, the humidifier comprising:

(a) a water supply for supplying water to a water control means;

(b) the water control means communicating with a container means for filling said container means with water and selectively controlling the water depth in said container means; and (c) the container means for storing water and mounted in close proximately to said warmed air such that water in said container means evaporates thereby humidifying the warmed air being exhausted;

wherein said container means comprises:

(d) a reservoir for housing said water control means and storing water;

(e) an evaporation means fluidly connected and receiving water from said reservoir said evaporation means for exposing water to said warmed air for facilitating evaporation of water thereby humidifying said warmed air;

(f) wherein the water depth of the evaporation means is less than the water depth in said reservoir such that said reservoir fills before said evaporation means fills;

(g) wherein said evaporation means comprises an evaporation pan mounted in close proximity to said firebox and said warmed air such that water in the evaporation pan, is heated by heat emanating from the firebox and also by warmed air passing over the water in the pan;

(h) wherein said evaporation pan comprises a sloped bottom wall such that the greater the water depth in the evaporation pan the greater the surface area of the water in the pan thereby the humidification rate can be adjusted by controlling the depth of water in the evaporation pan.

2. The humidifier claimed in claim 1 wherein said evaporation pan further comprises wicking means for accelerating and enhancing the rate of evaporation of water in the pan.

3. The humidifier claimed in claim 2 wherein said wicking means comprises upstanding wicks partially submerged in the water in the pan and partially exposed to the warmed air thereby increasing the evaporation rate of water in the pan.

4. A humidifier for installation in gas fired fireplaces of the type having an air intake opening and an air outlet opening and an airflow passage there between, in which air is warmed by a fireplace firebox, and exhausted into a room to be heated, the humidifier comprising:

(a) a water supply for supplying water to a water control means;

(b) the water control means communicating with a container means for filling said container means with water and selectively controlling the water depth in said container means; and (c) the container means for storing water and mounted in close proximately to said warmed air such that water in said container means evaporates thereby humidifying the warmed air being exhausted;

wherein said container means comprises:

(d) a reservoir for housing said water control means and storing water;

(e) an evaporation means, fluidly connected and receiving water from said reservoir said evaporation means for exposing water to said warmed air for facilitating evaporation of water thereby humidifying said warmed air;

(f) wherein the water depth of the evaporation means is less than the water depth in said reservoir such that said reservoir fills before said evaporation means fills;

(g) wherein said evaporation means comprises an evaporation pan mounted in close proximity to said firebox and said warmed air such that water in the evaporation pan, is heated by heat emanating from the firebox and also by warmed air passing over the water in the pan; and (h) wherein said humidifier includes shims placed under the evaporation pan, the shims placed in such a manner to provide a sloped bottom wall such that the greater the water depth in the evaporation pan the greater the surface area of the water in the pan thereby the humidification rate can be adjusted by controlling the depth of water in the evaporation pan.

5. The humidifier claimed in claim 1 or 4 wherein the water control means comprises;

(a) a float communicating with water level in the container means;

(b) a water valve communicating with said float for adding water to sad container and thereby maintaining the water depth in said container means at a preselected level.

6. The humidifier claimed in claim 2 wherein said wicking means includes water adsorptive materials useful for wicking water which can accelerate and enhance the rate of evaporation of water in the pan.

7. The humidifier claimed in claim 2 wherein said wicking means includes a plurality of wick holders for receiving said wicks such that wicks can be selectively placed in wick holders such that the humidification rate can be selected by increasing or decreasing the number of wicks.

8. A flat humidifier for installation in gas fired fireplaces of the type having an air intake opening and an air outlet opening and an airflow passage there between, in which air is warmed by a fireplace firebox, and exhausted into a room to be heated, the humidifier comprising:

(a) a water supply for supplying water to a water control means;

(b) the water control means communicating with a container means for filling said container means with water and selectively controlling the water depth in said container means; and (c) the container means for storing water and mounted in close proximately to said warmed air such that water in said container means evaporates thereby humidifying the warmed air being exhausted;

(d) wherein said container means comprises an evaporation pan mounted in close proximity to sad firebox and said warmed air such that water in the evaporation pan is heated by heat emanating from the firebox and also by warmed air passing over the water in the evaporation pan; and (e) wherein said evaporation pan further comprises a removable bottom adjacent to and lying on a pan bottom wall which can be easily removed from said evaporation pan.

9. The humidifier claimed in claim 8 wherein said removable bottom further comprises a plurality of wick holders disposed perpendicular to said removable bottom for receiving thereon wicking material for wicking water from said pan thereby accelerating the evaporation rate of water into said warmed air.

10. The humidifier claimed in claim 9 wherein said wicking material comprises upstanding wicks partially submerged in the water in the pan and partially exposed to the warmed air thereby increasing the evaporation rate of water in the pan.

11. The flat humidifier claimed in claim 8 wherein the water control means comprises;

(a) a float communicating with the water level in the pan; and (b) a water valve communicating with said float for adding water to said pan and thereby maintaining the water depth in said pan at a preselected level.

12. The humidifier claimed in claim 8 wherein said evaporation pan comprises a sloped bottom wall such that the greater the water depth in the evaporation pan the greater the surface area of the water in the pan thereby the humidification rate can be adjusted by controlling the depth of water in the evaporation pan.

13. The humidifier claimed in claim 8 wherein said humidifier includes shims placed under the evaporation pan, the shims placed in such a manner to provide a sloped bottom wall such that the greater the water depth in the evaporation pan the greater the surface area of the water in the pan thereby the humidification rate can be adjusted by controlling the depth of water in the evaporation pan.

* * * * *